United States Patent [19]

Marchev

[11] 4,201,900

[45] May 6, 1980

[54] SNAP ACTION TILT ACTUATED MERCURY SWITCH

[75] Inventor: George B. Marchev, Short Hills, N.J.

[73] Assignee: Gordos Corporation, Bloomfield, N.J.

[21] Appl. No.: 15,414

[22] Filed: Feb. 26, 1979

[51] Int. Cl.[2] ..... H01H 29/04

[52] U.S. Cl. ..... 200/220; 200/235

[58] Field of Search ..... 200/61.47, 61.52, 67 MS, 200/186, 220, 224, 225, 235, 236

[56] References Cited

U.S. PATENT DOCUMENTS 3,755,643 8/1973 Blair ..... 200/220

*Primary Examiner*—Stephen Marcus

*Attorney, Agent, or Firm*—John C. Dorfman

[57] ABSTRACT

A mercury tilt switch is provided with electrodes which during operation are oriented in a vertical plane projecting through an end wall of an elongated insulating envelope. The lower electrode is longer than the other and terminated with a blunt end of area of such size and shape as to provide resistance to the surrounding movement of the mercury pool past the end and the subsequently reduced steps of the electrode. When the switch is tilted to close the contacts, the blunt end opposes the mercury pool until the switch is sufficiently tilted that the weight component of the mercury in direction opposed to the blunt end is sufficient to overcome surface tension of the mercury pool, at which point the mercury pool will flow down along the stepped electrode and into contact with the other electrode closing the switch.

11 Claims, 6 Drawing Figures

SNAP ACTION TILT ACTUATED MERCURY SWITCH

The present invention relates to a new switch configuration for a snap acting tilt acting mercury switch. More specifically, it relates to construction of a new snap acting mercury switch which does not require precise electrode adjustment and will operate effectively as a snap action switch at a very low tilt angle.

Prior art mercury tilt switches have typically been devices requiring a high tilt angle away from the horizontal in order to close the switch contacts or have provided such a geometry that it will operate at a low angle, but not always with precisely identifiable reference positions.

The switch of the present invention is of such a type that it will operate within a low tilt angle of less than one degree which may be only slightly of horizontal. The construction takes advantage of the surface tension of the liquid mercury to prevent actuation until a specified tilt angle occurs. This is the result of providing the mercury in such a position that it must pass first the blunt end of the penetrating electrode before that electrode can penetrate the mercury. The area and orientation of the blunt end is such that it causes the mercury to be restrained until the gravity force component urging the surrounding mercury past the electrode is sufficiently great to overcome surface tension and allow the electrode to enter the body of the mercury. This condition is an always the same for a given geometry and configuration of materials in a switch so that the results are highly repeatable. Moreover, when the critical angle is reached, the mercury not only moves past the barrier imposed by the blunt end of the electrode, but then immediately accelerates over the steps of subsequently reduced cross sections to the position in which it contacts the other electrode, thus giving the switch a definite "snap action" effect.

More specifically, the switch of the present invention is a tilt actuated mercury switch which has an elongated envelope of electrically insulating material sealed off from the atmosphere. A pair of electrodes, each supported on and within the envelope, provide conductive means which extend through the envelope to terminals outside of the envelope to provide electrical connection to the electrodes. The electrodes and their supporting structure are arranged in a vertical plane to extend from one end side by side into the envelope generally in the direction of its elongation. With the electrodes in a vertical plane the lower one of said electrodes projects further into the envelope than the higher one and terminates in an enlarged blunt termination. A mass of cohesive conductive liquid, such as mercury, is located within the envelope. In its horizontal orientation, starting with the conductive liquid out of contact with both electrodes the enlarged blunt end of the lower electrode is closer to the mercury pool and inhibits passing that end. The weight of the mercury is sufficiently great to overcome the surface tension to enable the mercury to pass the blunt end of the lower electrode when the switch is tilted out of horizontal to an angle where the weight effect overcomes surface tension. The mercury pool must be sufficiently small to clear both electrodes when tilted in one direction and sufficiently large to contact both electrodes when tilted in the other direction. The position of the lower electrode is such that it requires penetration of the mercury pool as it passes.

The blunt termination on the lower electrode is of sufficient size to effectively block passage of the liquid mass until the tilt is sufficient to produce enough gravity component in opposition to overcome liquid tension surface effect of said liquid mass. All described low tilt angle switch constructions have specially treated internal glass surface to practically eliminate mercury adhesion. Such condition results in freely moving mercury pool that is extremely sensitive and responsive to external forces.

For a better understanding of the present invention, reference is made to the accompanying drawings in which.

Figure 1:
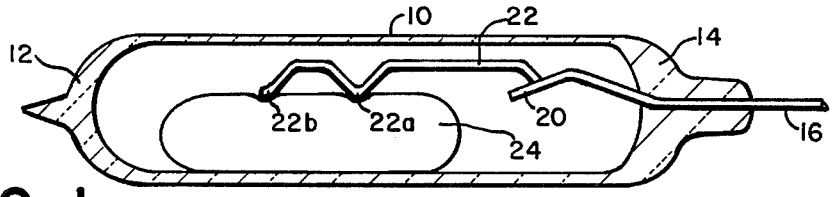
FIG. 1 (PRIOR ART)
FIG. 1 is an axial sectional side view of a prior art mercury switch.
Figure 2:
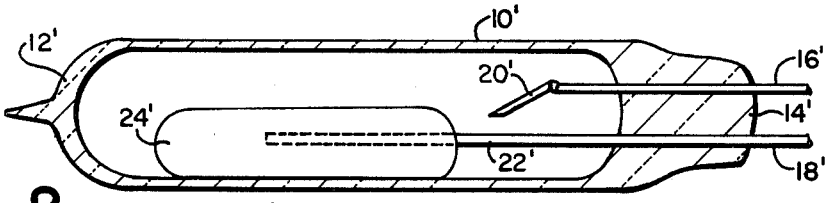
FIG. 2 (PRIOR ART)
FIG. 2 is a similar side view of a modified switch.

Reference will be made first to FIGS. 1 and 2 which show prior art constructions.

In FIG. 1, an elongated generally cylindrical glass envelope 10 having generally tubular sidewalls is closed at opposite ends by endwall closures 12 and 14. Endwall closure 14 provides a conventional press through which parallel conductive leads 16 and 18 extend. Lead 16 terminates within the envelope in an electrode 20 which extends only a short distance relative to total length of the envelope beyond the press. Electrode 22 extends lead and terminal 18 (not seen) further into the envelope beyond the press. Both electrodes 20 and 22 are mercury non-wetable. Electrode 20 is provided with a slight bend to insure that its inner end will engage a cohesive body of conductive liquid mercury 24. Electrode 22 is provided with two successive bends **22*a* and 22*b* which are intended to bring the electrode into contact with the mercury which is of a size to contact the two electrodes 20 and 22 at a level just above the bottom of the lowermost extending portions of the respective electrodes. The bends 22*a* and 22*b* also act as two pressure points upon mercury pool 24. The FIG. 1 shows the mercury pool in a balanced horizontal position in which the length of the pool is symmetrical to the points of 22*a* and 22*b***. Such practically unstable condition (or position) is too sensitive to be used for reference in actual switch operation.

As can be envisioned by observation of FIG. 1, a slight degree of tilt will cause the mercury 24 to move in the direction of the tilt, but it will not cause the mercury to substantially change shape, and its total thickness will remain essentially the same. Thus, lowering the righthand end as viewed in FIG. 1 will cause the mercury to move into contact with electrode 20. This sliding movement of mercury pool 24 will be stopped by the endwall closure 14 causing the mercury pool to rebound with a tendency to interrupt the established contact with electrode tip 20.

Such bounce-back movement is restricted by the effect of the pressure point **22*a*, at the other end of mercury pool 24**, thus preventing contact interruption.

To open the "contact 20" the end of the switch remote from the contacts is lowered below horizontal. The mercury pool 24 will slide to the lowered end and the bounce-back movement will be similarly restricted by the pressure point 22*b* preventing undesirable momentary contact with tip 20.

The prior art structure of FIG. 1 calls for a very precise height adjustment of all electrodes relative to the height of the movable mercury pool 24. Moreover, it restricts the area of the conductive interface. Consequently, the switch electric load handling capability is limited to very low current.

FIG. 2 of the prior art represents a similar type of switch to that shown in FIG. 1. Instead of both electrodes being mercury non-wetted, both electrodes are mercury wetted. Corresponding elements of the switch are numbered with similar number designators to those used in FIG. 1 with additions of primes thereto. Such a switch has advantages over the non-mercury wetted switch, but it is more expensive since materials which are wet include some of the higher cost metals or processes. The electrode 22′ must be a small diameter in order to maintain low switch operating tilt angle. The conditions specified limit switching capability in increased electrical load conditions.

Figure 3:
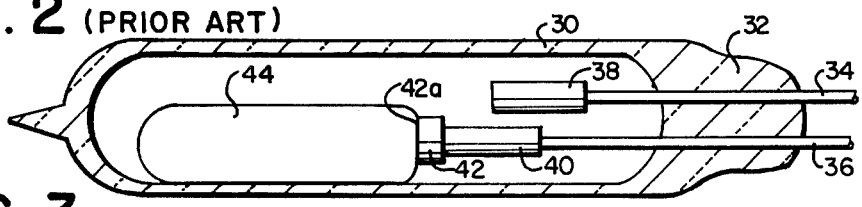
FIG. 3 is a side view similar to FIG. 2 showing the switch of the present invention in horizontal position such that the contacts of the switch are open.
Figure 4:
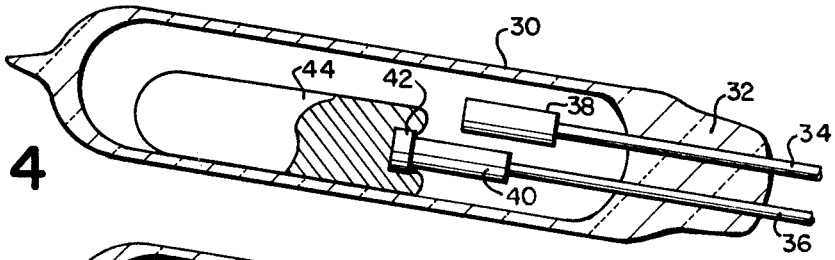
FIG. 4 is a side view showing mercury pool just starting the snap-action motion as the switch has been tilted in operate position.
Figure 5:
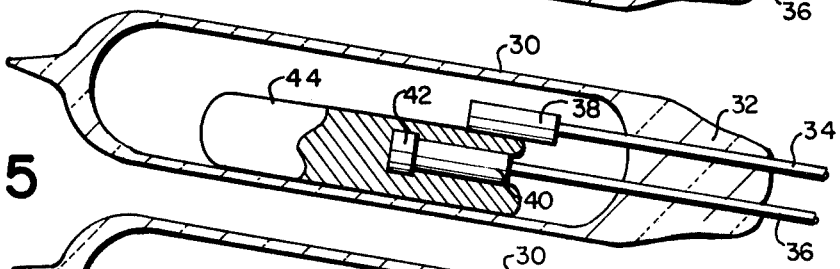
FIG. 5 shows the moving mercury pool closing the contacts while the switch remains in position shown in FIG. 4.

Referring now to FIGS. 3, 4, 5 and 6, the preferred embodiment of the present invention is illustrated. As seen, the structure is similar to the prior art device in that it has a similar insulating generally cylindrical envelope 30 of glass, or other suitable insulating material. It is provided with a press 32 at one end of the glass envelope through which pass leads 34 and 36, each providing a terminal externally and support means internally for electrode structure. Lead 34 supports a simple cylindrical electrode member 38 of larger diameter than the lead. Lead 36 supports a similar electrode structure 40 which has an enlarged endpiece 42 presenting a larger area blunt end face 42*a* to globular mercury pool 44. In operation electrodes 38 and 40 are positioned in a vertical plane so that the blunt face 42*a* of end piece is directly opposed to and deters penetration of electrode 40 into the mercury pool 44. The end face 42*a* may be mercury wettable, but the rest of the electrodes structure, including the balance of piece 42 and electrode 40 as well as electrode 38, are not wet by the mercury. The area presented by the blunt end face 42*a* is of such size and design including peripheral shape and possible form as to provide the function of acting as a deterent to the passage of the mercury pool 44 as the right end of the structure shown in FIG. 3 is tilted downward out of the horizontal. Preferably, this face 42*a* is a smooth circular flat face, but it may be of a variety of shapes. The nature of the enlarged face of this blunt end of the electrode 40, in any event, is to deter the flow of pool 44. The size of the pool and envelope and electrode 40 geometry is such that the mercury pool cannot bypass the electrode but must await overcoming surface tension by the blunt end to allow penetration of the mercury pool by lower electrode 40. As can be seen by the progressive FIGS. 4, 5 and 6, when tilt of the envelope 30 is sufficient to cause the gravity forces on the mercury tube sufficient to overcome the surface tension effect, the mercury pool 44 advances past the blunt end face 42*a*. At that point, a snap action occurs in that the mercury pool will move then rapidly over the non-wettable surfaces of the reduced cross section of the electrode portions 42 and 40, as shown in FIG. 4 and FIG. 5, and ultimately assume a position shown in FIG. 6 with the enlarged electrode structure completely within the mercury pool. As the mercury moves from the position of FIG. 4 to the position of FIG. 5, it contacts electrode 38 which is positioned in accordance with the design of the structure and size of the mercury pool provided so that it will be contacted without having substantial retarding effect to the fast movement of mercury pool 44.

The glass envelope is hermatically sealed and may be provided with an atmosphere, such as hydrogen or hydrogen and nitrogen gas. The interior of the glass envelope is preferably surface treated to obtain a very high mercury contact angle or a nonadhesive condition to the mercury.

Figure 6:
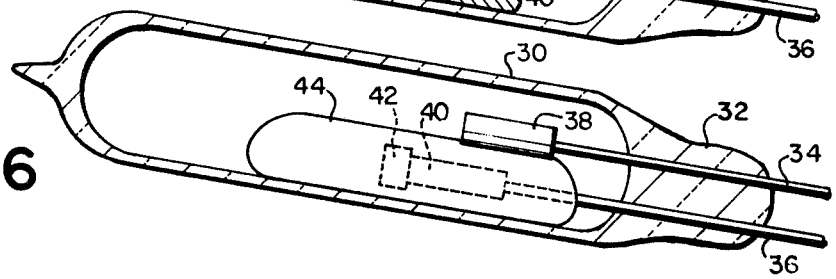
FIG. 6 is a side view showing the switch in fully closed contact position with no change in tilt angle.

The drawings somewhat exaggerate the relative size of electrodes and the necessary tilt away from horizontal required for operation of the switch. FIG. 3 is intended to represent horizontal condition of the switch, and in that position as shown, the switch is open. By tilting the switch approximately 1°, lowering the electrode end of the capsule, the condition of the switch is changed to closed. However, the orientation from the position of FIG. 3 to the position of FIG. 6 is done in one movement, and the conditions of the mercury pool in FIGS. 4, 5 and 6, simply represent transitions as the electrode 40 penetrates the mercury pool after the operating position of the switch is assumed. The sliding movement of the mercury pool 44 is stopped by the press or the pinch type glass to metal seal and the mercury rebounds from its extreme position slightly. The rebound movement is deterred by the step formed between the larger electrode 40 and the lead 36 thus inhibiting interruption of contact with electrode 38 as shown in FIG. 5.

When the switch is opened it must be tilted back near the horizontal position to cause the mercury pool 44 to clear both electrodes in one snap-acting movement to ultimately assume the minimum surface free energy condition shown in FIG. 3 or with the mercury pool further to the left and out of contact with face 42*a*.

On the reverse tilt, the snap acting movement of mercury pool 44 will not start until a specified tilt angle occurs because the step from cross section of lead 36 to the larger cross section of electrode 40 acts as a barrier deterrent until the shifted gravity forces overcome the mercury surface tension. This reverse snap action can be understood by referring to the mercury pool configuration of FIG. 5 and applying the discussion of the switch action applicable to FIGS. 3 to 6.

In summary, the start of the snap acting movement in both directions of tilt is quite definite and specific to the switch operating position, and is produced similarly at both ends of the lower internal electrode.

Mercury may be pure or doped in some way in accordance with other teachings in the art. The electrodes may be relatively inexpensive materials in accordance with the present invention, but, of course, should be preferably of materials which will not deteriorate under conditions of use as is known in the art. Other modifications to the structure shown and described are possible. All such modifications within the scope of the claims are intended to be within the scope and spirit of the present invention.

I claim:

1. A tilt actuated conductive liquid switch comprising:

an elongated envelope of electrically insulating material sealed off from the atmosphere, a pair of electrodes each supported on and within the envelope and providing conductive means which extends through the envelope to terminals outside the envelope providing electrical connection to said electrodes, their electrodes and their supporting structure being arranged in a vertical plane during operation to extend from one end side-by-side into the envelope generally in the direction of elongation, the lower one of said electrodes projecting further into the envelope than the higher one and terminating in a blunt termination, such that in the selected operating orientation the envelope is arranged generally horizontally with the lower electrode projecting furtherest into the envelope beneath the other electrode, and a mass of cohesive conductive liquid within said envelope, the mass being sufficiently great and the position of the lower electrode being such as to require penetration by the lower electrode as it passes to contact the shorter higher electrode and sufficiently small to clear both electrodes except when tilted with the electrode and lowered, the blunt termination on the lower electrode being of sufficient area in a transverse direction opposed to liquid movement and proper shape to effectively block passage of the liquid mass until the liquid surface tension effect thereof is overcome by the component of weight opposed to it, in order to provide a snap action effect.

2. The tilt switch of claim 1 in which the conductive liquid is mercury.

3. The tilt switch of claim 2 in which the electrodes are enlarged cylinders having generally parallel axes extending lengthwise of the envelope.

4. The tilt switch of claim 3 in which the electrodes are mercury non-wettable.

5. The tilt switch of claim 2 in which the blunt termination of the electrode projecting further into the envelope has a generally planar, generally circular base.

6. The tilt switch of claim 5 in which the face that opposes the mercury is of mercury wettable material.

7. The tilt switch of claim 3 in which the lower cylindrical electrode has steps of two or more cross section of different size.

8. The tilt switch of claim 7 in which the lower electrode has rectangular cross sections.

9. The tilt switch of claim 2 in which said envelope is glass which is surface treated to produce a very high mercury contact angle.

10. The tilt switch of claim 2 in which the lower electrode at the supported end is connected to a conductive lead of small cross-section relative to the electrode in a manner providing a shoulder discontinuity opposing reverse flow of the mercury when it surrounds the electrode.

11. The tilt switch of claim 3 in which the lower cylindrical electrode at the supported end is connected coaxially to a smaller diameter generally circular conductive lead in a manner providing a shoulder discontinuity opposing reverse flow of the mercury when it surrounds the electrode.

* * * * *

UNITED STATES PATENT AND TRADEMARK OFFICE

CERTIFICATE OF CORRECTION

PATENT NO. : 4,201,900
DATED : May 6, 1980
INVENTOR(S) : George B. Marchev

It is certified that error appears in the above-identified patent and that said Letters Patent are hereby corrected as shown below:

In the Abstract:

lines 6 and 7, delete "surrounding";
line 7, insert "surrounding" before "mercury".

In the Specification:

Column 3, line 59, "As" should start a new paragraph.

Signed and Sealed this

*Twelfth* Day of *August 1980*

[SEAL]

*Attest:*

SIDNEY A. DIAMOND

*Attesting Officer*

*Commissioner of Patents and Trademark.*